US011254468B1

(12) United States Patent
Erickson

(10) Patent No.: US 11,254,468 B1
(45) Date of Patent: Feb. 22, 2022

(54) PALLET SYSTEM FOR RAILINGS

(71) Applicant: Safety Rail Company, LLC, Spring Park, MN (US)

(72) Inventor: Craig Erickson, Deephaven, MN (US)

(73) Assignee: Safety Rail Company, LLC, Spring Park, MN (US)

( * ) Notice: Subject to any disclaimer, the term of this patent is extended or adjusted under 35 U.S.C. 154(b) by 0 days.

(21) Appl. No.: 16/914,650

(22) Filed: Jun. 29, 2020

Related U.S. Application Data

(60) Provisional application No. 62/867,386, filed on Jun. 27, 2019.

(51) Int. Cl.
*B65D 19/00* (2006.01)
*B65D 21/02* (2006.01)

(52) U.S. Cl.
CPC ..... *B65D 19/0095* (2013.01); *B65D 21/0201* (2013.01); *B65D 2519/00024* (2013.01); *B65D 2519/00034* (2013.01); *B65D 2519/00059* (2013.01); *B65D 2519/00069* (2013.01); *B65D 2519/00233* (2013.01); *B65D 2519/00243* (2013.01); *B65D 2519/00273* (2013.01); *B65D 2519/00796* (2013.01); *B65D 2519/00815* (2013.01); *B65D 2519/00965* (2013.01); *B65D 2519/00985* (2013.01)

(58) Field of Classification Search
CPC ..... B65D 19/44; B65D 21/0201
USPC ..... 108/55.3, 55.1
See application file for complete search history.

(56) References Cited

U.S. PATENT DOCUMENTS 3,375,793 A * 4/1968 Wagner ..... B65D 19/16 108/56.1
3,590,752 A * 7/1971 De Pew ..... B65D 19/44 108/55.3
3,927,764 A * 12/1975 Fox ..... B65D 85/48 206/451
4,342,268 A * 8/1982 Grava ..... B65D 85/62 108/55.1
4,437,412 A * 3/1984 Trautsch ..... B65D 19/385 108/115
4,921,100 A * 5/1990 Krause ..... B65D 19/44 206/448
5,676,066 A * 10/1997 Cavalier ..... B65D 19/44 108/55.1

(Continued)

FOREIGN PATENT DOCUMENTS

CN 104936866 9/2015
CN 207029979 2/2018

(Continued)

*Primary Examiner* — Jose V Chen
(74) *Attorney, Agent, or Firm* — Christensen, Fonder, Dardi & Herbert PLLC

(57) ABSTRACT

A pallet system for shipping and storage of railing segments. The pallet system captures the corners of a plurality of railing segments, thereby diminishing the weight, footprint, and materials of construction requirements. In some embodiments, a plurality of the pallet systems can be stacked. The diminished size of the pallet system components after removal of the railing segments can be returned to the shipper in a refund exchange arrangement. In some embodiments, the plurality of railing segments is maintained in a fixed relationship using a spacer that is inserted laterally through the plurality of railing segments.

20 Claims, 9 Drawing Sheets

(56) References Cited

U.S. PATENT DOCUMENTS

| | | | | |
|---|---|---|---|---|
| 7,918,165 | B2 * | 4/2011 | Owen | B65D 19/44 108/55.1 |
| 2004/0131441 | A1 * | 7/2004 | Kessler | B65D 19/44 410/155 |
| 2005/0183375 | A1 * | 8/2005 | Yamamoto | B65D 19/10 52/633 |
| 2006/0108307 | A1 * | 5/2006 | Kin | A47F 5/13 211/189 |
| 2008/0000397 | A1 * | 1/2008 | Dickinson | B65D 19/20 108/55.3 |
| 2009/0071381 | A1 * | 3/2009 | Ponto | B65D 85/48 108/55.5 |
| 2009/0078660 | A1 * | 3/2009 | Kin | A47F 7/17 211/60.1 |
| 2012/0325764 | A1 * | 12/2012 | Gerkensmeier | B65D 25/06 211/175 |
| 2013/0277267 | A1 | 10/2013 | Valiulis | |
| 2015/0239610 | A1 | 8/2015 | Weyrauch | |
| 2018/0303236 | A1 * | 10/2018 | Thompson | B65D 19/44 |
| 2019/0016503 | A1 | 1/2019 | Weyrauch et al. | |
| 2019/0233163 | A1 * | 8/2019 | Hamner | B65D 19/0048 |
| 2020/0071064 | A1 * | 3/2020 | Bublitz | B65D 85/62 |
| 2020/0180837 | A1 * | 6/2020 | Burns | B65D 25/04 |
| 2020/0198077 | A1 * | 6/2020 | Andujo | B21D 43/18 |
| 2020/0198835 | A1 * | 6/2020 | Burns | B65D 25/04 |

FOREIGN PATENT DOCUMENTS

| | | | | |
|---|---|---|---|---|
| EP | 0143299 | A2 | 6/1985 | |
| EP | 0270512 | | 6/1988 | |
| FR | 2426613 | | 12/1979 | |
| KR | 1020170081771 | | 7/2017 | |
| WO | WO 2014/056858 | | 4/2014 | |
| WO | WO-2019021281 | A2 * | 1/2019 | A47B 45/00 |

* cited by examiner (Fig. 9)

PALLET SYSTEM FOR RAILINGS

RELATED APPLICATIONS

This patent application claims the benefit of U.S. Provisional Patent Application No. 62/867,386, filed Jun. 27, 2019, the disclosure of which is hereby incorporated by reference herein in its entirety.

FIELD OF THE DISCLOSURE

This application is directed generally to pallet systems for shipping and storage, and more specifically to pallet systems for shipping and storing railings.

BACKGROUND

Safety railing systems are erected around or adjacent a work area, typically an elevated work area such as on a roof, to prevent workers from straying outside of a designated safe zone. Safety railing systems are typically modular, with railing segments that enable the railings to be tailored to the shape of a zone or boundary, and also enabling the zone or boundary to be reconfigured as the work site is altered or shifted.

Shipping of the railing segments is typically done with large pallets to which the railing segments are secured. Conventional pallets for shipping railing segments can weigh in excess of 100 pounds and include platforms with a footprint larger than the railing segments. The pallets add to the overall shipping and storage costs. A pallet system that is smaller and lighter and less costly to produce would be welcomed.

SUMMARY OF THE DISCLOSURE

Various embodiments of the disclosure present a pallet system for railings that is compact and light weight with respect to conventional pallets or pallet systems that are used for shipping railings. Such safety railing systems may include a large number identically constructed railing segments. The disclosed system incorporates those railings themselves as structural members, substantially reducing the materials required to fabricate the pallets. The reduced material requirement saves on the cost of pallet fabrication as well as shipping costs due to reduction in weight and footprint. In some embodiments, the pallet system enables railing bundles to be stacked in an interlocked manner to help secure the railing bundles from shifting during shipment. The pallet components sans the railings are modular and may be reused. Accordingly, the pallet components may be returned to the railing vendor for re-use, for example in a refund return arrangement.

Structurally, in various embodiments of the disclosure, a pallet system is disclosed comprising a bottom edge bracket including a bottom rack portion, the bottom rack portion defining a first plurality of through-apertures that are spaced along a first axis, an upper face of the bottom rack portion defining a first plurality of registration channels, each of the first plurality of registration channels being centered about a respective registration plane to define a first plurality of registration planes of the bottom rack portion, the first plurality of registration planes being orthogonal to the first axis, each registration channel of the first plurality of registration channels coplanar with and centered about a respective registration plane of the first plurality of registration planes; and a top edge bracket including a top rack portion, the top rack portion defining a second plurality of through-apertures that are spaced along a second axis, a lower face of the top rack portion defining a second plurality of registration channels, each of the second plurality of registration channels being centered about a respective registration plane to define a second plurality of registration planes of the top rack portion, the second plurality of registration planes being orthogonal to the second axis, each registration channel of the second plurality of registration channels being coplanar with and centered about a respective registration plane of the second plurality of registration planes. The top edge bracket may be suspended above the bottom edge bracket so that the lower face of the top rack portion faces the upper face of the bottom rack portion and the first axis of the bottom edge bracket is coplanar with the second axis of the top edge bracket. In some embodiments, each through-aperture of the first plurality of through-apertures of the bottom rack portion is centered about a respective registration plane of the second plurality of registration planes of the top edge bracket. Each through-aperture of the second plurality of through-apertures of the top rack portion may be centered about a respective registration plane of the first plurality of registration planes of the bottom edge bracket.

In some embodiments, the first plurality of through-apertures and the second plurality of through-apertures are uniformly shaped. The first plurality of through apertures may be uniformly spaced along the first axis, and the second plurality of through apertures may be uniformly spaced along the second axis. The first axis and the second axis may be linear. In some embodiments, the first plurality of registration channels of the bottom rack portion defines a first plurality of arcuate axes, each arcuate axis of the first plurality of arcuate axes extending orthogonal to the first axis and being coplanar with a respective registration plane of the first plurality of registration planes. The second plurality of registration channels of the top rack portion may define a second plurality of arcuate axes, each arcuate axis of the second plurality of arcuate axes extending lateral to the second axis and being coplanar with a respective registration plane of the second plurality of registration planes. In some embodiments, each registration channel of the first plurality of registration channels includes a concave surface that is concave relative to the upper face of the bottom rack portion, the concave surface of the registration channel of the upper face of the bottom rack defining a radius that is normal to a corresponding arcuate axis of the first plurality of arcuate axes, and each registration channel of the second plurality of registration channels includes a concave surface that is concave relative to the lower face of the top rack portion, the concave surface of the registration channel of the lower face of the top rack defining a radius that is normal to a corresponding arcuate axis of the second plurality of arcuate axes.

In some embodiments, the bottom edge bracket includes a base assembly that suspends the bottom edge bracket, and the top edge bracket includes an addendum supported by the top rack portion. The bottom edge bracket may include a first plurality of blind apertures defined on the base assembly, each blind aperture of the first plurality of blind apertures being in alignment with a respective through-aperture of the first plurality of through-apertures along a respective axis that is coplanar with a respective registration plane of the first plurality of registration planes and perpendicular to the first axis. In some embodiments, the base assembly is configured to mount on the addendum, and may include features configured to interlock for restricting lateral movement of the bottom edge bracket with respect to the top edge bracket. In some embodiments the features include a locking aperture defined on one of the base assembly and the addendum and a protrusion on the other of the addendum and the base assembly, the protrusion being configured to mate with the aperture. The bottom edge bracket may define a pair openings for accommodation of fork lift tines, each of the pair of openings facing in a direction that is orthogonal to the first axis. Each of the pair of openings may be normal to the direction that is orthogonal to the first axis.

In various embodiments of the disclosure, the pallet system includes a first plurality of railing segments that suspends the top edge bracket above the bottom edge bracket, wherein: the first plurality of railing segments includes a first plurality of vertical posts, each vertical post of the first plurality of vertical posts being associated with a respective railing segment of the first plurality of railing segments, each vertical post of the first plurality of vertical posts being disposed in a respective through-aperture of the first plurality of through-apertures of the bottom rack portion; and the first plurality of railing segments includes a first plurality of corner portions, each corner portion of the first plurality of corner portions being associated with the respective railing segment of the first plurality of railing segments, each corner portion of the first plurality of corner portions being disposed in a respective registration channel of the second plurality of registration channels of the top rack portion. The pallet system may further include a second plurality of railing segments, wherein: the second plurality of railing segments includes a second plurality of vertical posts, each vertical post of the second plurality of vertical posts being associated with a respective railing segment of the second plurality of railing segments, each vertical post of the second plurality of vertical posts being disposed in a respective through-aperture of the second plurality of through-apertures of the top rack portion; and the second plurality of railing segments includes a second plurality of corner portions, each corner portion of the second plurality of corner portions being associated with the respective railing segment of the second plurality of railing segments, each corner portion of the second plurality of corner portions being disposed in a respective registration channel of the first plurality of registration channels of the bottom rack portion.

In various embodiments of the disclosure, the pallet system includes a spacer, wherein: the first plurality of railing segments includes a first plurality of mid-railings, each mid-railing of the first plurality of mid-railings being associated with a respective railing segment of the first plurality of railing segments, each mid-railing of the first plurality of mid-railings extending from a respective vertical post of the first plurality of vertical post and being coplanar with a respective registration plane of the first plurality of registration planes. The second plurality of railing segments may include a second plurality of mid-railings, each mid-railing of the second plurality of mid-railings being associated with a respective railing segment of the second plurality of railing segments, each mid-railing of the second plurality of mid-railings extending from a respective vertical post of the second plurality of vertical posts and being coplanar with a respective registration plane of the second plurality of registration planes. In some embodiments, the bottom edge bracket may be configured to support the first plurality railing segments and the second plurality of railing segments so that a vertical clearance is defined between the first plurality of mid-railings and the second plurality of mid-railings. The spacer may be inserted within the vertical clearance to extend through the first plurality of railing segments and the second plurality of railing segments. In some embodiments, the spacer is proximate the first plurality of vertical posts and the second plurality of vertical posts, and may extend substantially parallel to the first axis of the bottom rack portion.

In various embodiments of the disclosure, a method for shipping a plurality of railing segments is disclosed, comprising: arranging a first plurality of railing segments laterally with respect to each other, each of the first plurality of railing segments being in a first orientation, each of the first plurality of railing segments including a cross member to define a first plurality of cross-members; arranging a second plurality of railing segments laterally with respect to each other, each of the second plurality of railing segments being in a second orientation, each of the second plurality of railing segments including a cross member to define a second plurality of cross-members. the second orientation being inverted from the first orientation, the second plurality of railing segments being laterally interspersed with the first plurality of railing segments; and inserting a spacer between the first plurality of cross members and the second plurality of cross members, the first plurality of cross members being adjacent a first registration surface of the spacer, the second plurality of cross members being adjacent a second registration surface of the spacer, the second registration surface of the spacer being opposite the first registration surface of the spacer. In some embodiments, the cross member is a mid-railing. The method may include coupling the first plurality of railing segments to the second plurality of railing segments. The coupling may be performed by wrapping a band around the first plurality of railing segments and the second plurality of railing segments.

DETAILED DESCRIPTION OF THE DRAWINGS

Figure 1:
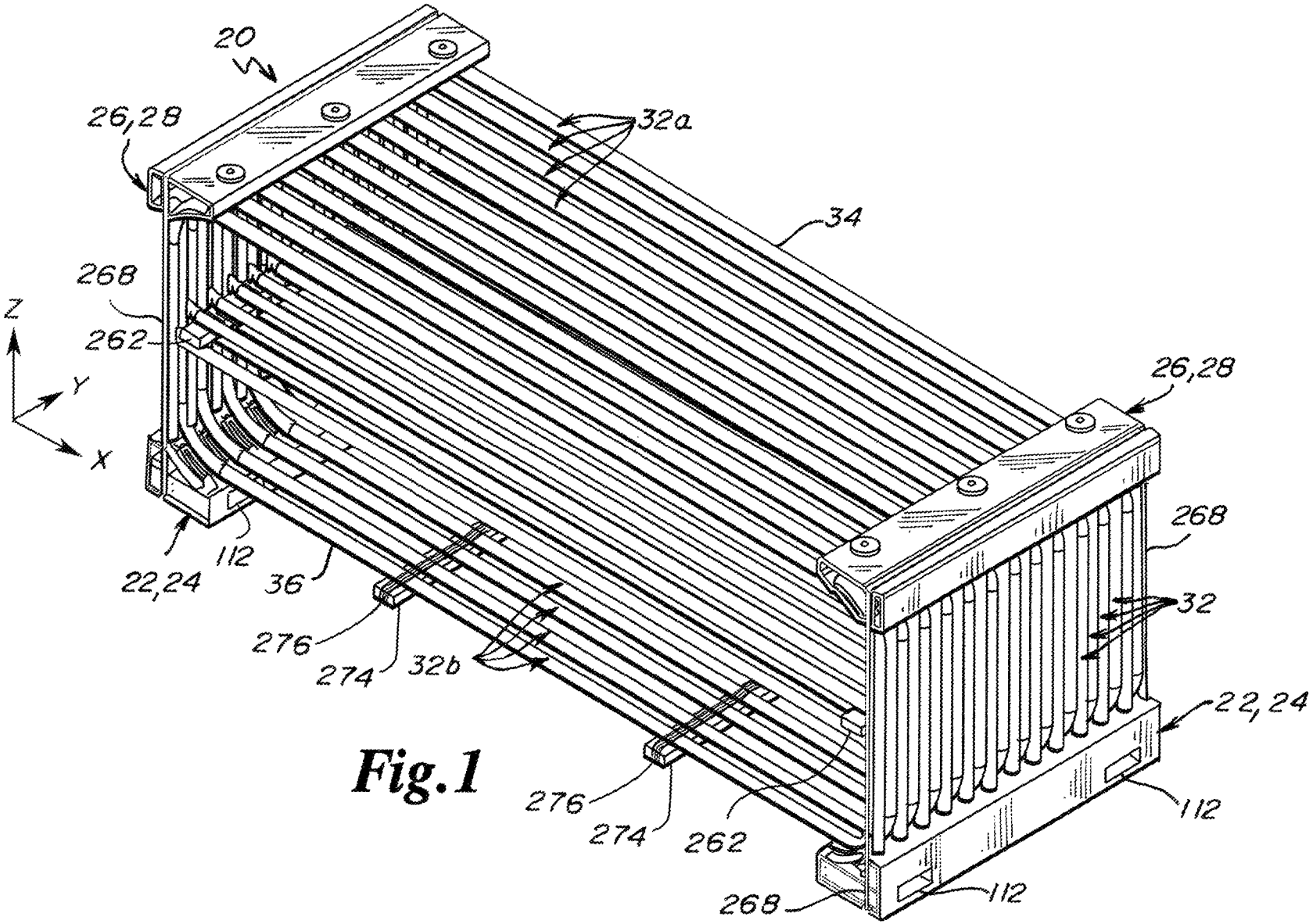
FIG. 1 is a perspective view of a pallet system for railings according to an embodiment of the disclosure.

Referring to FIG. 1, a pallet system 20 for shipping and storage of railing segments is depicted according to an embodiment of the disclosure. The pallet system 20 includes a bottom edge bracket 22 disposed at each lower corner 24 of the pallet system 20, and a top edge bracket 26 disposed at each upper corner 28 of the pallet system 20. The brackets 22 and 26 are separated by a plurality of railing segments 32. The plurality of railing segments 32 may include a first plurality of railing segments 32*a* that are supported in a first orientation (an upright configuration 34 in FIG. 1), and a second plurality of railing segments 32*b* that are supported in a second orientation that is inverted with respect to the first orientation.

Referring to FIGS. 2 through 7, the bottom edge bracket 22 is depicted in more detail according to an embodiment of the disclosure. The bottom edge bracket 22 may include a bottom rack portion 52 supported by a base assembly 54. In some embodiments, the bottom rack portion 52 defines a first plurality of through-apertures 62 that are spaced along a first lateral axis 64. In some embodiments, the first lateral axis 64 is linear. Each through-aperture 60 of the plurality of through-apertures 62 may also be of uniform shape (depicted). In some embodiments, the through-apertures 60 are oblong in shape, with a major diameter 65 that extends orthogonal to the first lateral axis 64.

Figure 6:
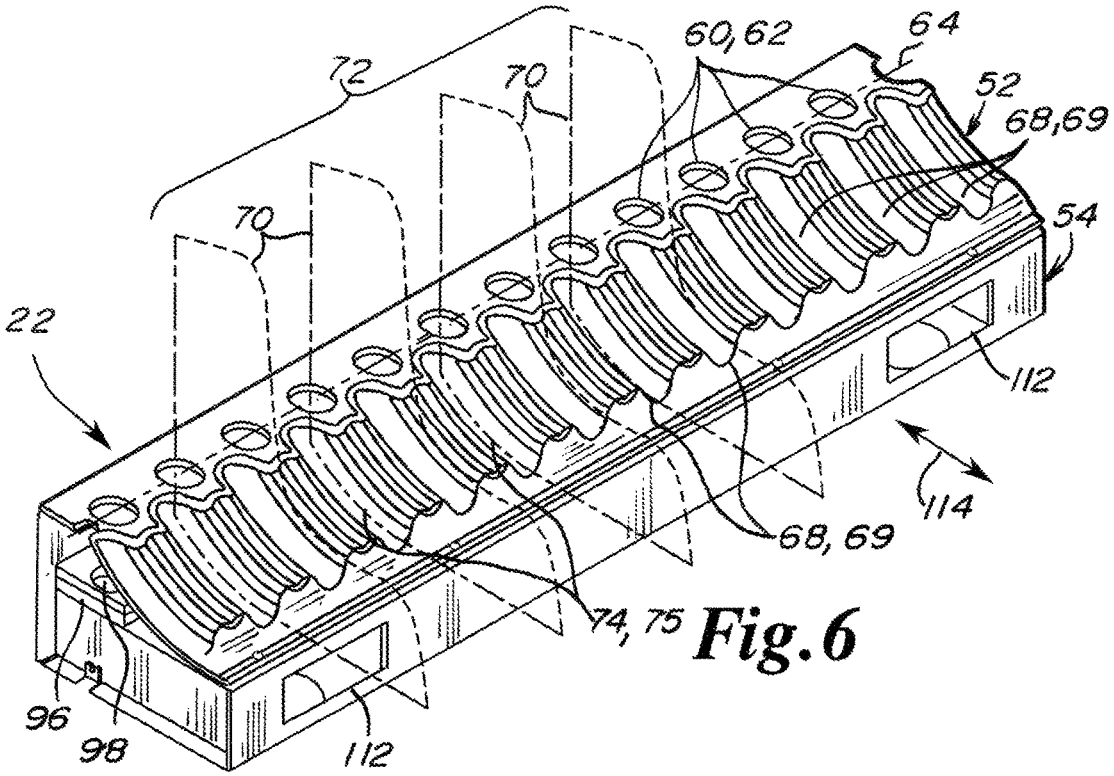
FIG. 6 is an upper perspective view of the assembled bottom edge bracket of FIG. 2 according to an embodiment of the disclosure.
Figure 7:
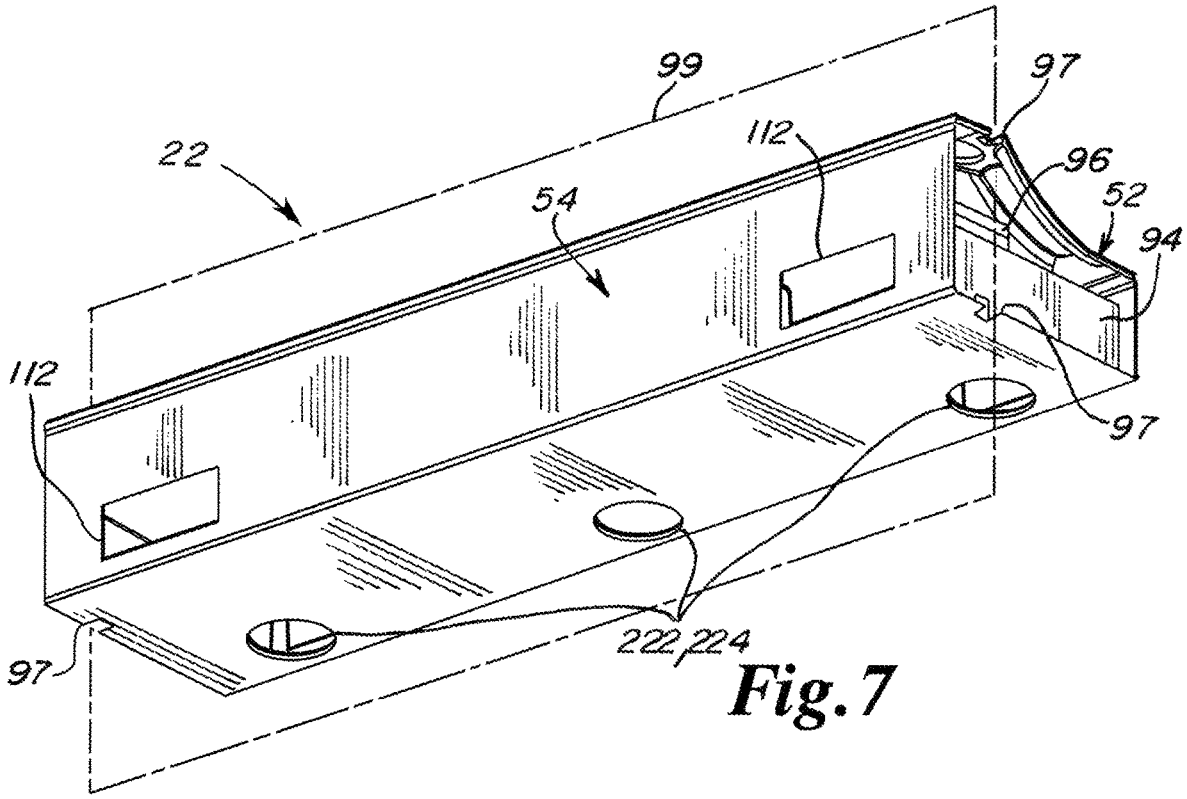
FIG. 7 is a lower perspective view of the assembled bottom edge bracket of FIG. 2 according to an embodiment of the disclosure.
Figure 8:
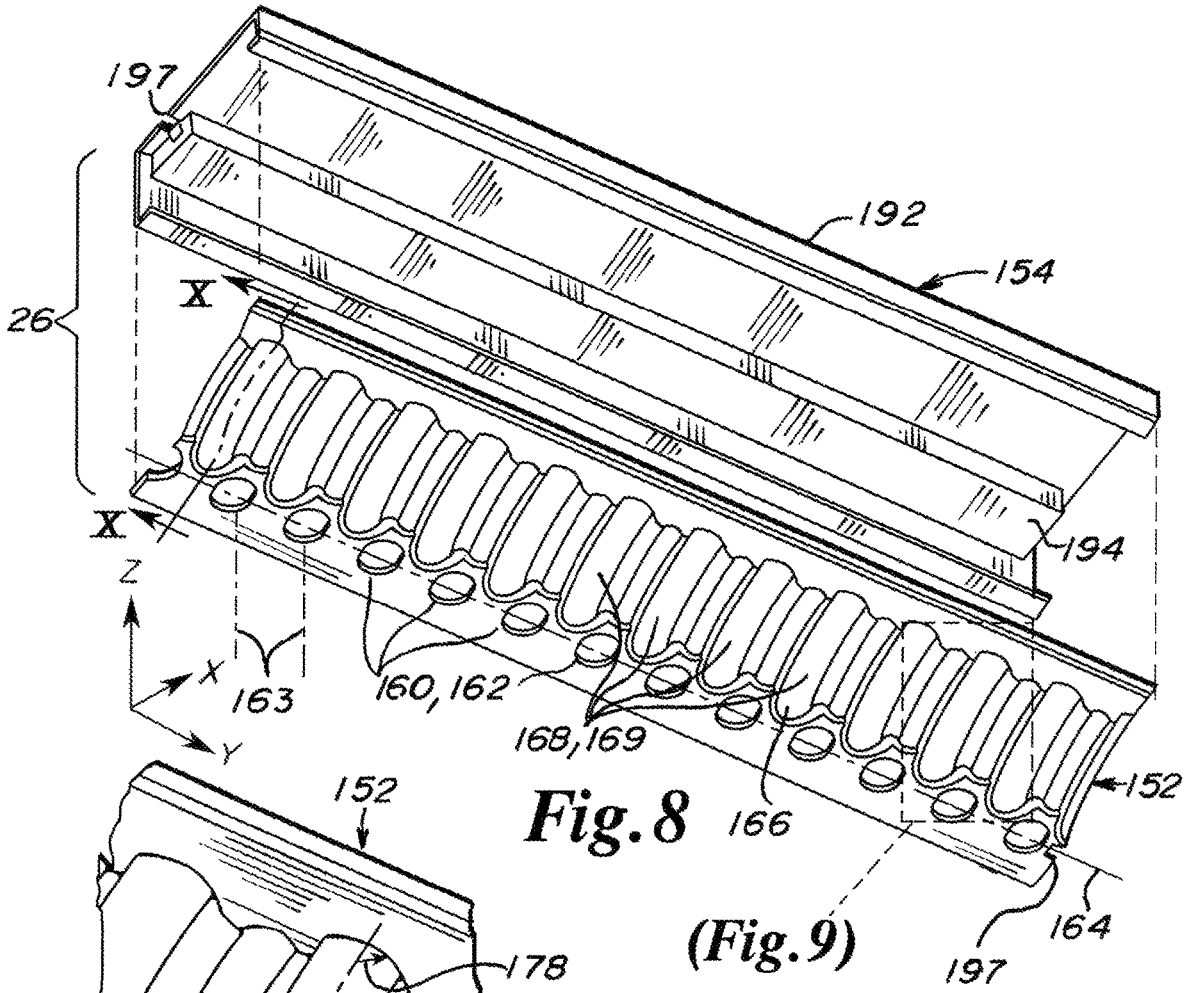
FIG. 8 is an exploded, perspective view of a top edge bracket of the pallet system of FIG. 1 according to an embodiment of the disclosure.
Figure 9:
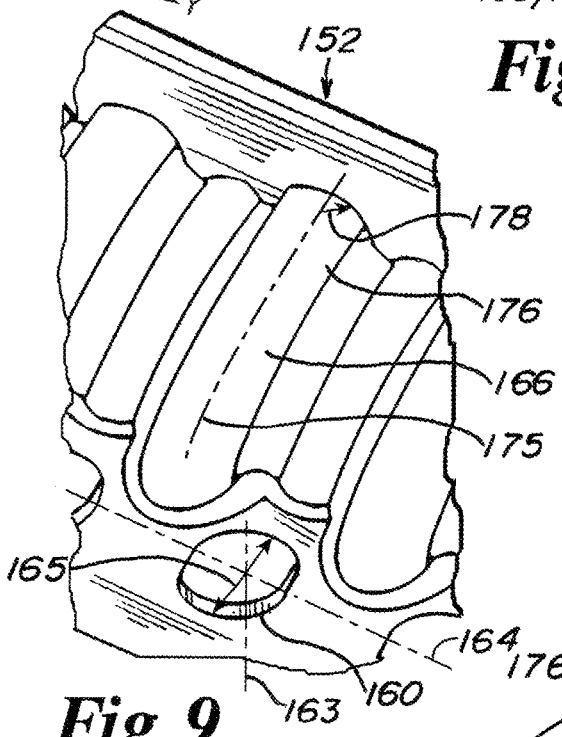
FIG. 9 is an enlarged perspective view of a through-aperture and registration channel of a top rack portion of the top edge bracket of FIG. 8 according to an embodiment of the disclosure.
Figure 10:
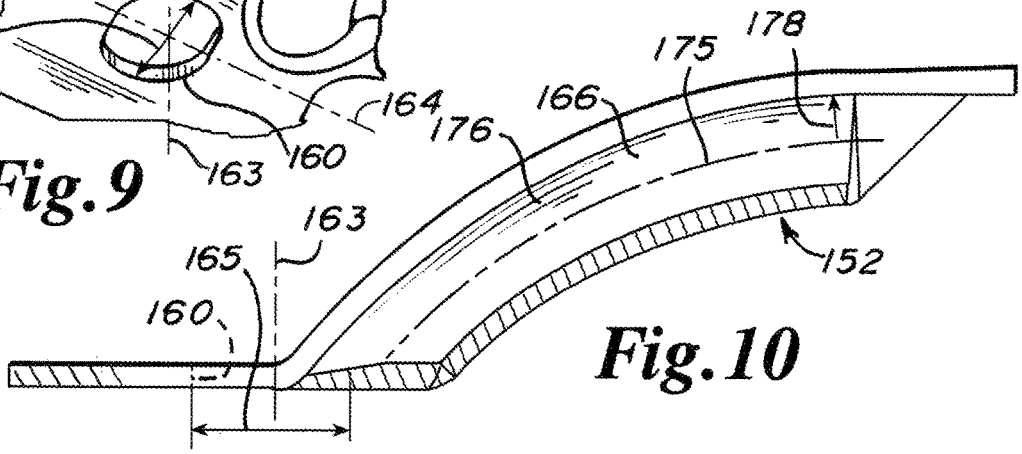
FIG. 10 is a sectional view of the top rack portion at line X-X of FIG. 8 according to an embodiment of the disclosure.
Figure 11:
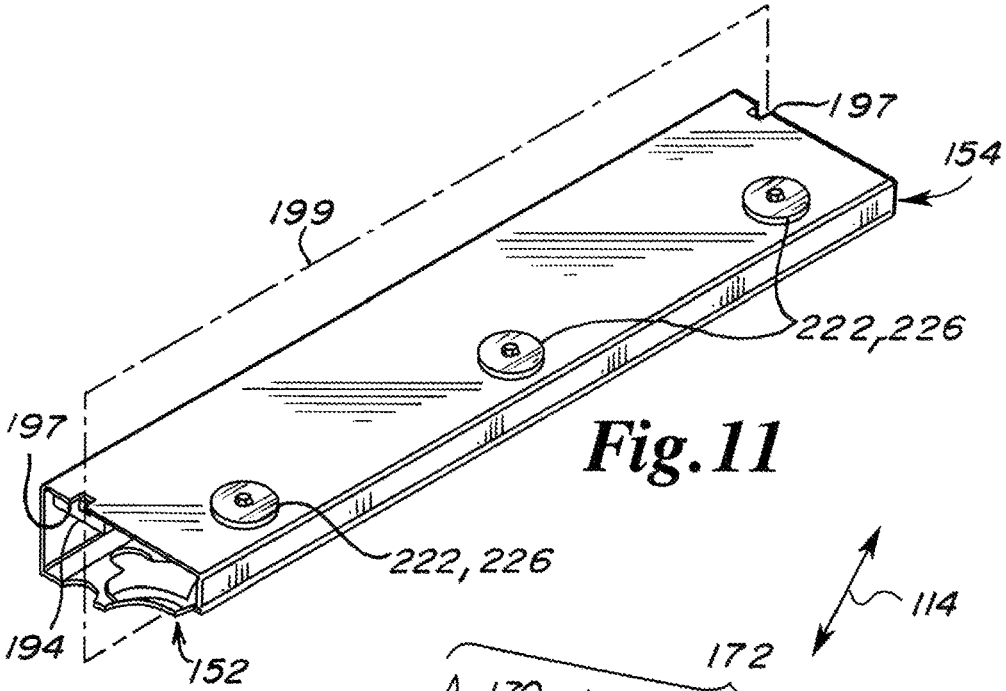
FIG. 11 is an upper perspective view of the assembled top edge bracket of FIG. 8 according to an embodiment of the disclosure.

An upper face 66 of the bottom rack portion 52 may define a first plurality of registration channels 68, each registration channel 69 of the first plurality of registration channels 68 being centered about a respective registration plane 70 of a first plurality of registration planes 72 of the bottom rack portion 52 (FIG. 6). In some embodiments, the first plurality of registration planes 72 are orthogonal to the first lateral axis 64, each registration channel 69 of the first plurality of registration channels 68 being coplanar with and centered about a respective registration plane 70 of the first plurality of registration planes 72. The bottom edge bracket 22 may be fabricated from a material suitable for molding or stamping, for example a polymer or metal.

Figures 2, 3, 4, 5:
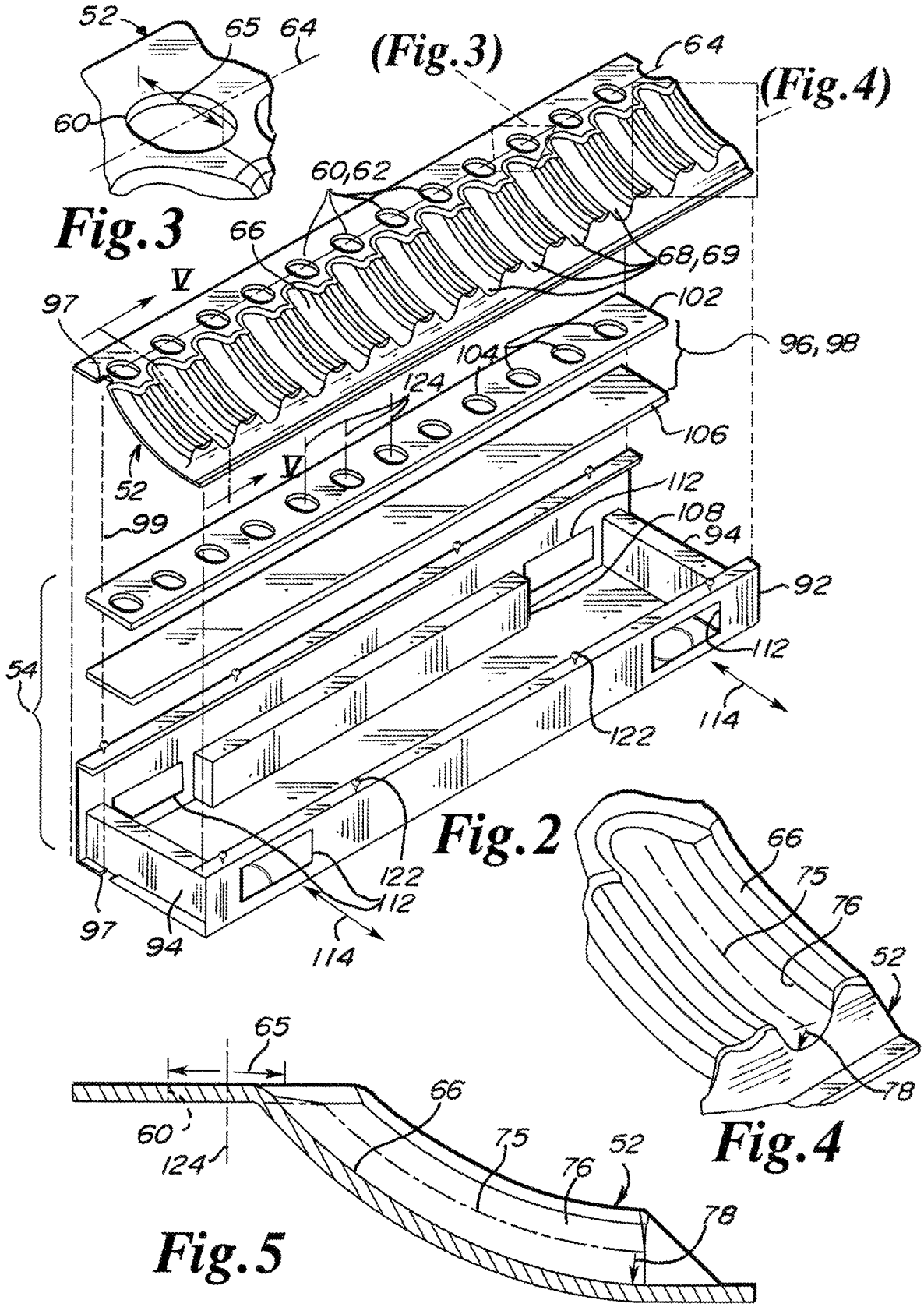
FIG. 2 is an exploded, perspective view of a bottom edge bracket of the pallet system of FIG. 1 according to an embodiment of the disclosure.
FIG. 3 is an enlarged perspective view of a through-aperture of a bottom rack portion of the bottom edge bracket of FIG. 2 according to an embodiment of the disclosure.
FIG. 4 is an enlarged perspective view of an arcuate channel of the bottom rack portion of the bottom edge bracket of FIG. 2 according to an embodiment of the disclosure.
FIG. 5 is a sectional view of the bottom rack portion at line V-V of FIG. 2 according to an embodiment of the disclosure.

In some embodiments, each of the first plurality of registration channels 68 of the bottom rack portion 52 are arcuate, defining a first plurality of arcuate axes 74, each arcuate axis 75 of the first plurality of arcuate axes 74 extending orthogonal to the first lateral axis 64 and being coplanar with a respective registration plane 70 of the first plurality of registration planes 72. Each registration channel 69 of the first plurality of registration channels 68 may include a concave surface 76 that is concave relative to the upper face 66 of the bottom rack portion 52, the concave surface 76 defining a radius 78 that is normal to a corresponding arcuate axis 75 of the first plurality of arcuate axes 74 (FIG. 4).

The base assembly 54 may include a support housing 92 with block gussets 94. In some embodiments, the base assembly 54 includes a support plate 96 that extends parallel to and below the first lateral axis 64, the support plate 96 defining a plurality of blind apertures 98. In some embodiments, the support housing 92 and bottom rack portion 52 define a plurality of grooves or notches 97 that define and are centered about a vertical plane 99. In some embodiments, the vertical plane 99 is coplanar with the first lateral axis 64 of the bottom rack portion 52.

The number of blind apertures 98 of the support plate 96 is the same as the number of through-apertures 60 of the bottom rack portion 52, and the centers of the blind apertures 98 are spaced in the same arrangement as the centers of the through-apertures 60. The support plate 96 may include an upper strip 102 that defines a plurality of apertures 104 and a lower strip 106 that blanks off the apertures 104 of the upper strip 102 to form the blind apertures 98. In some embodiments, the support plate 96 is supported by a support beam 108 that extends underneath the support plate 96 and may extend at least part of the length of the support plate 96. The base assembly 54 may define openings 112 sized to accommodate fork lift tines. In some embodiments, the openings 112 may face in fore/aft directions 114 that are orthogonal to the first lateral axis 64 and may be normal to the fore/aft directions 114.

Herein, "fore/aft" arbitrarily refers to a direction that is substantially parallel to the registration planes 70 and orthogonal to the first lateral axis 64, "lateral" arbitrarily refers to a direction that is substantially orthogonal to the registration planes 70 and parallel to the first lateral axis, and "vertical" arbitrarily refers to a direction that is parallel to both the registration planes 70 and the first lateral axis 64. In terms of the Cartesian coordinate depicted in FIG. 1, "fore/aft" is parallel to the x-axis, "lateral" is parallel to the y-axis, and "vertical" is parallel to the z-axis.

For assembly of the base assembly 54, the top edges of the block gussets 94 and support beam 108 are arranged coplanar, and the support plate 96 affixed thereto. The bottom rack portion 52 is affixed to the base assembly 54 (for example, with fasteners 122) so that the upper face 66 faces away from the base assembly 54. The bottom rack portion 52 is positioned on the base assembly 54 so that each of through-apertures 60 are in alignment with a respective blind aperture 98 along a respective vertical axis 124 that parallel to the first plurality of registration planes 72 and perpendicular to the first lateral axis 64.

Referring to FIGS. 8 through 12, the top edge bracket 26 is depicted in greater detail according to an embodiment of the disclosure. The top edge bracket 26 may include a top rack portion 152 that supports an addendum 154 coupled to the top rack portion 152. In some embodiments, the top rack portion 152 defines a second plurality of through-apertures 162 that are spaced along a second lateral axis 164 and each being concentric about a vertical axis 163. In some embodiments, the second lateral axis 164 is linear. Each through-aperture 160 of the plurality of through-apertures 162 may also be of uniform shape (depicted). In some embodiments, the through-apertures 160 are oblong in shape, with a major diameter 165 that extends orthogonal to the second lateral axis 164.

Figure 12:
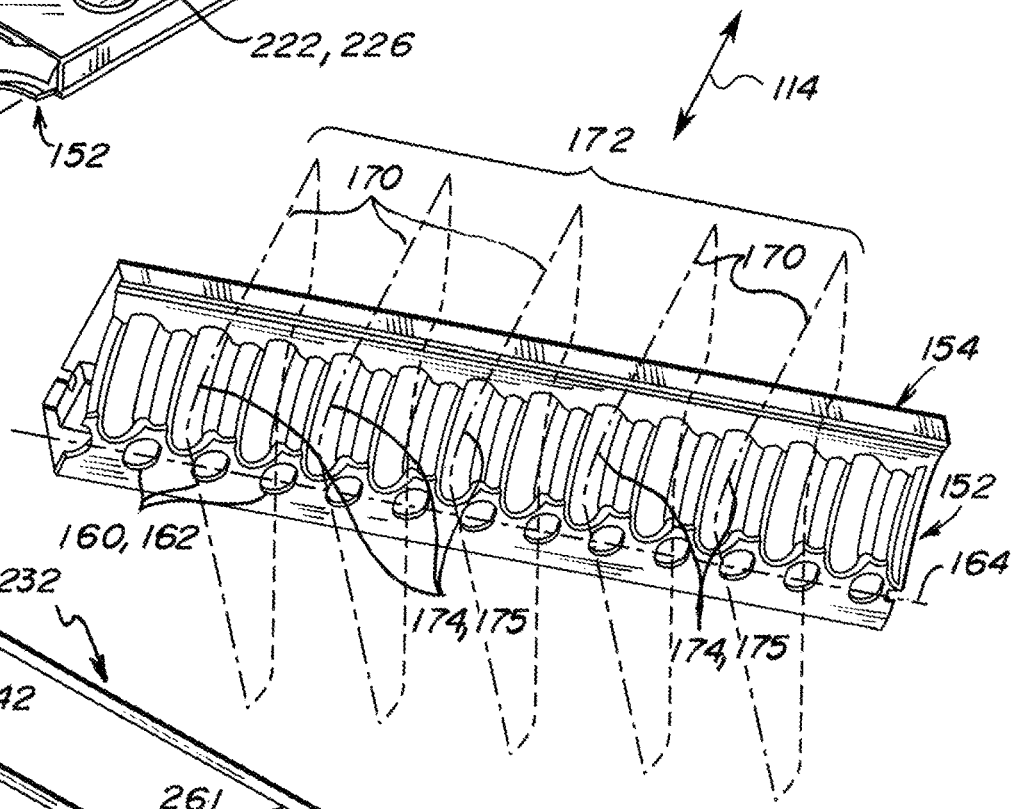
FIG. 12 is a lower perspective view of the assembled top edge bracket of FIG. 8 according to an embodiment of the disclosure.

A lower face 166 of the top rack portion 152 may define a second plurality of registration channels 168, each registration channel 169 of the second plurality of registration channels 168 being centered about a respective registration plane 170 of a second plurality of registration planes 172 of the top rack portion 152. In some embodiments, the second plurality of registration planes 172 are orthogonal to the second lateral axis 164, each registration channel 169 of the second plurality of registration channels 168 being coplanar with and centered about a respective registration plane 170 of the second plurality of registration planes 172 (FIG. 12). The top edge bracket 26 may be fabricated from a material suitable for molding or stamping, for example a polymer or metal.

In some embodiments, each registration channel 169 of the second plurality of registration channels 168 of the top rack portion 152 are arcuate, defining a second plurality of arcuate axes 174, with each arcuate axis 175 of the second plurality of arcuate axes 174 extending orthogonal to the second lateral axis 164 in the fore/aft direction 114 and being coplanar with a respective registration plane 170 of the second plurality of registration planes 172. Each registration channel 169 of the second plurality of registration channels 168 may include a concave surface 176 that is concave relative to the lower face 166 of the top rack portion 152, the concave surface 176 defining a radius 178 that is normal to a corresponding arcuate axis 175 of the second plurality of arcuate axes 174.

In some embodiments, the addendum 154 includes a housing 192 that extends vertically from the top rack portion 152. The addendum 154 may include a support beam 194 that extends parallel to and above the second lateral axis 164 of the top rack portion 152. In some embodiments, the housing 192 and top rack portion 152 defines a plurality of grooves or notches 197 that define and are centered about a vertical plane 199. In some embodiments, the vertical plane 199 is coplanar with the second lateral axis 164 of the top rack portion 152.

In some embodiments, each vertical axis 124 of the bottom edge bracket 22 is coplanar with a respective registration plane 170 of the second plurality of registration planes 172 of the top edge bracket 26 and is perpendicular to the first lateral axis 64. Likewise, each vertical axis 163 of the top edge bracket 26 may be coplanar with a respective registration plane 70 of the first plurality of registration planes 72 of the bottom edge bracket 22 and perpendicular to the second lateral axis 164.

The housings 92, 192 may be fabricated from a material of suitable strength, for example plywood or sheet metal. The gussets 94, support plate 96, support beams 108, 194 may be fabricated from metal, wood, polymer, or a composite material.

In assembly, the top edge bracket 26 is suspended above the bottom edge bracket 22 so that the lower face 166 of the top rack portion 152 faces the upper face 52 of the bottom rack portion 52 and the first lateral axis 64 of the bottom edge bracket 22 is coplanar with the second lateral axis 164 of the top edge bracket 26. Each through-aperture 60 of the first plurality of through-apertures 62 of the bottom rack portion 52 is centered about a respective registration plane 170 of the second plurality of registration planes 172 of the top edge bracket 26, and each through-aperture 160 of the second plurality of through-apertures 162 of the top rack portion 26 is centered about a respective registration plane 70 of the first plurality of registration planes 72 of the bottom edge bracket 22.

In some embodiments, the base assembly 54 is configured to mount on the addendum 154. That is, while the base assemblies 54 depicted in FIG. 1 do not mount on the addendums 154 of FIG. 1, they are configured as such so that a plurality of pallet systems 20 having base assemblies 54 and addendums 154 can be stacked. In some embodiments, the base assembly 54 and the addendum 154 include interlocking features 222 configured mate with each other. In some embodiments, the interlocking features 222 include a locking aperture 224 (FIG. 7) defined on one of the base assembly 54 and the addendum 154 and a protrusion 226 on the other of the addendum 154 and the base assembly 156, the protrusion 226 being configured to mate with the aperture 224. For example, in the depicted embodiment, the locking aperture 224 is a circular through-hole and the protrusion 226 a circular disk dimensioned to fit within the circular through-hole.

Figure 13:
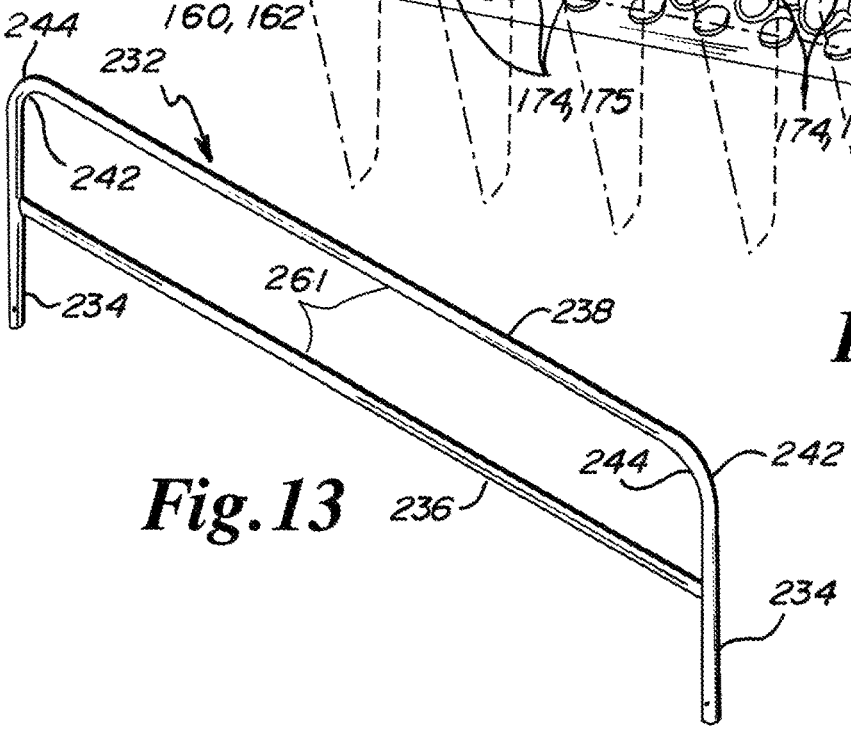
FIG. 13 is a perspective view of an example railing for packaging in the pallet system of FIG. 1 according to an embodiment of the disclosure.

Referring to FIG. 13, a railing segment 232 of the plurality of railing segments 32 is depicted according to an embodiment of the disclosure. Each railing segment 232 may include a pair of vertical posts 234 separated by one or more cross-members 235, such as a mid-railing 236 and a top or hand railing 238 (depicted). In some embodiments, each vertical post 234 transitions into the top railing 238 with a corner portion 242. The corner portion 242 may define an arcuate profile 244.

Referring to FIGS. 14 through 18, assembly of the pallet system 20 is depicted according to an embodiment of the disclosure. In some embodiments, the first plurality of railing segments **32*a* suspends the top edge bracket 26 above the bottom edge bracket 22. The first plurality of railing segments 32*a* presents a first plurality of vertical posts 246*a*. For the depicted embodiment, each vertical post 234 of the first plurality of vertical posts 246*a* is disposed in a respective through-aperture 60 of the first plurality of through-apertures 62 of the bottom rack portion 22. The first plurality of railing segments 32*a* includes a first plurality of corner portions 248*a*, each corner portion 242 of the first plurality of corner portions 248*a* being associated with the respective railing segment 232 of the first plurality of railing segments 32*a*, each corner portion 242 of the first plurality of corner portions 248*a* being disposed in a respective registration channel 169 of the second plurality of registration channels 168 of the top rack portion 152**.

The pallet system 20 may also be assembled with the second plurality of railing segments **32*b*. The second plurality of railing segments 32*b* includes a second plurality of vertical posts 246*b*, each vertical post 234 of the second plurality of vertical posts 246*b* being associated with a respective railing segment 232 of the second plurality of railing segments 32*b*, each vertical post 234 of the second plurality of vertical posts 246*b* being disposed in a respective through-aperture 160 of the second plurality of through-apertures 162 of the top rack portion 152. The second plurality of railing segments 32*b* includes a second plurality of corner portions 248*b*, each corner portion 242 of the second plurality of corner portions 248*b* being associated with the respective railing segment 232 of the second plurality of railing segments 32*b*, each corner portion 242 of the second plurality of corner portions 248*b* being disposed in a respective registration channel 69 of the first plurality of registration channels 68 of the bottom rack portion 52**.

Figure 15:
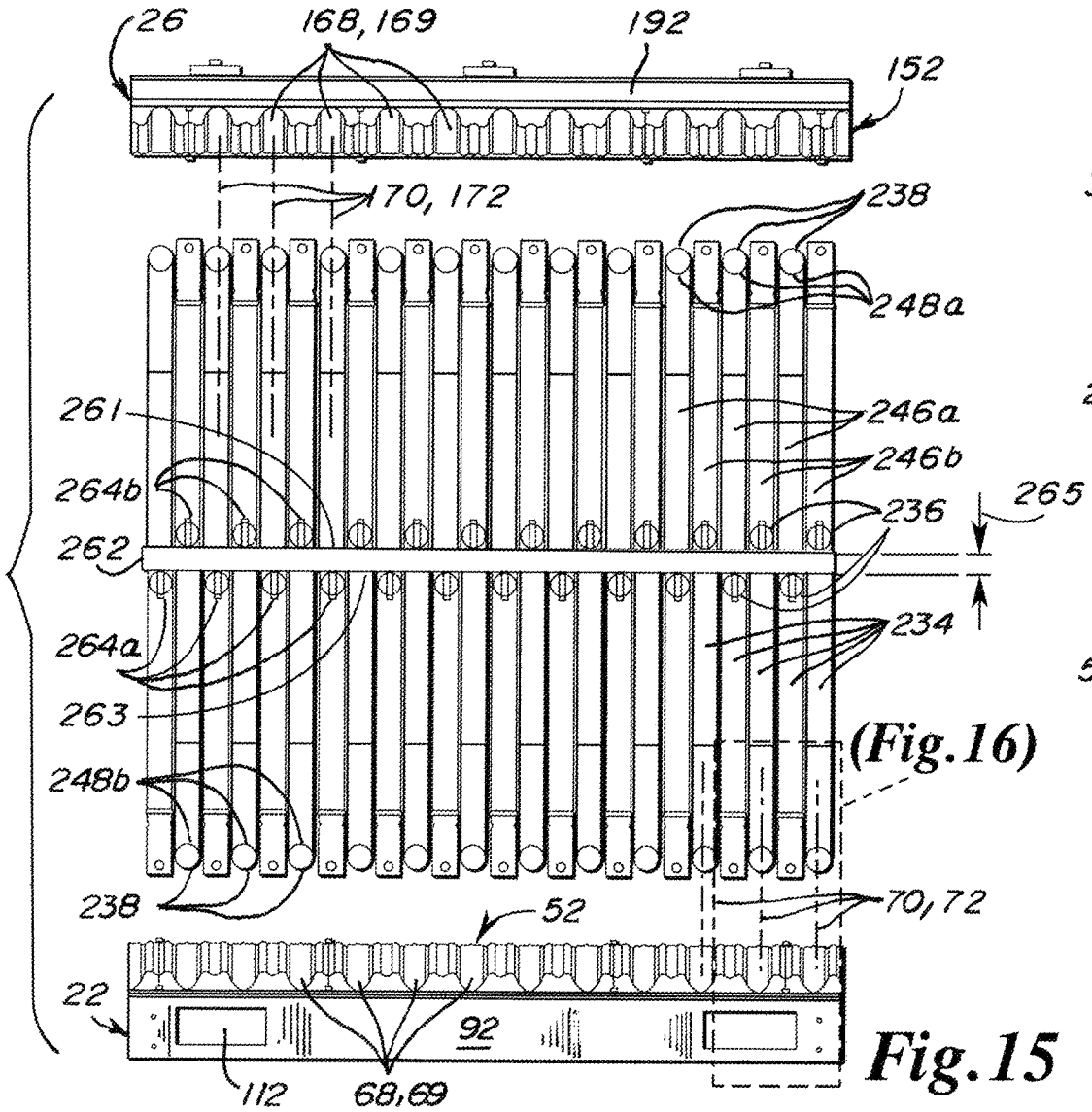
FIG. 15 is an exploded sectional view of the of the pallet system of FIG. 1 at plane XV-XV of FIG. 14 according to an embodiment of the disclosure.
Figure 17:
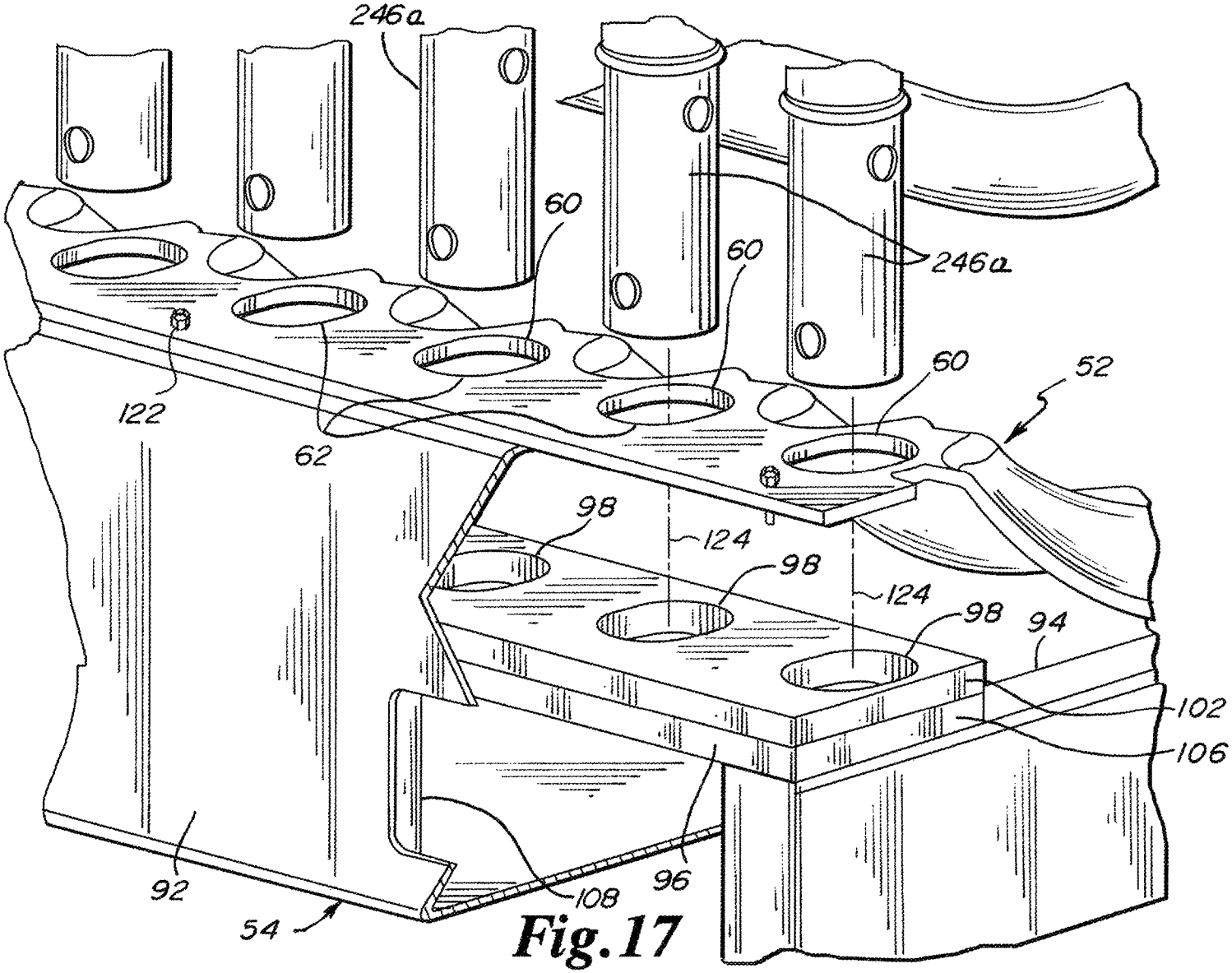
FIG. 17 is a partial exploded perspective view of the pallet system of FIG. 1 at a bottom edge bracket according to an embodiment of the disclosure.
Figure 18:
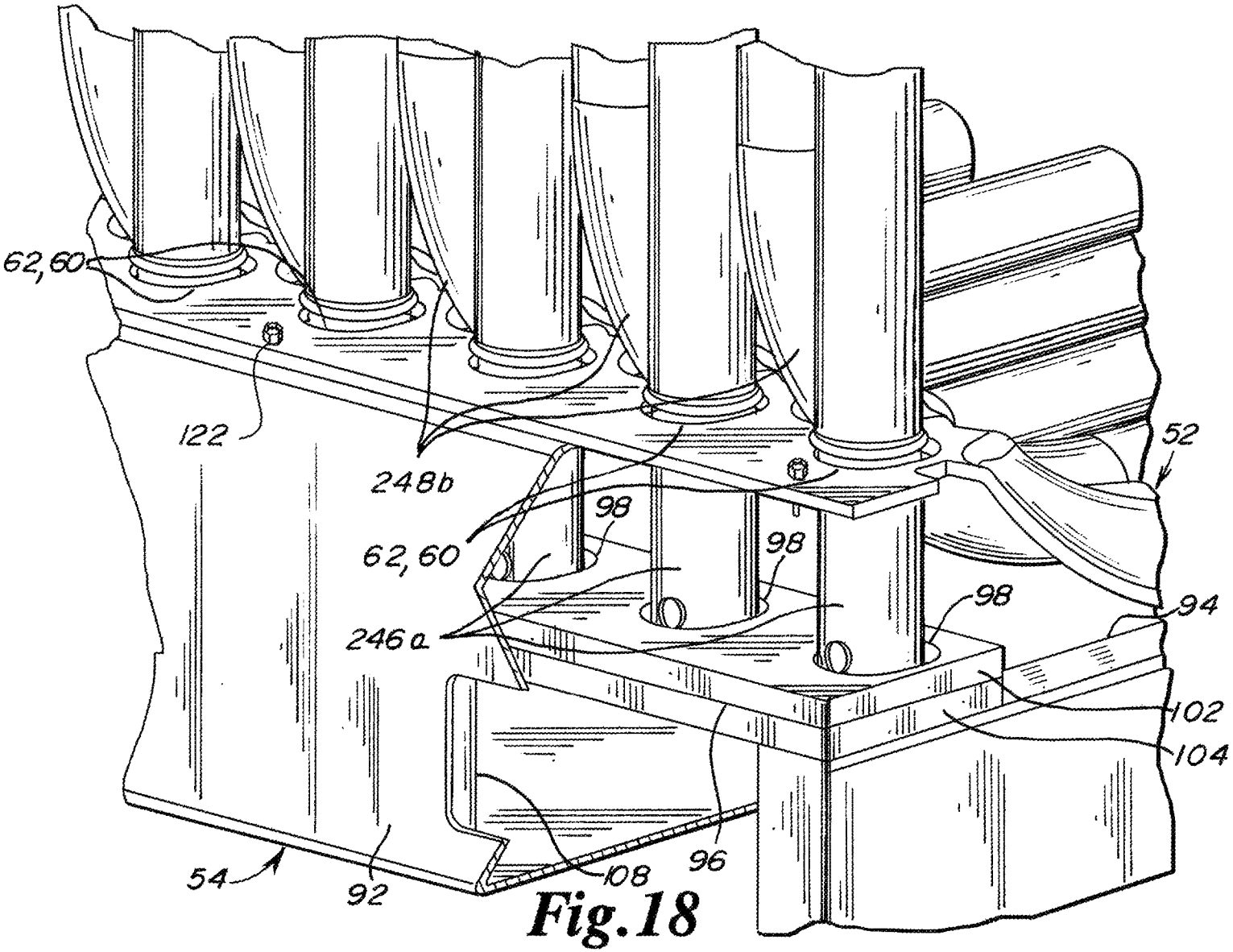
FIG. 18 is a partially assembled perspective view of FIG. 17 according to an embodiment of the disclosure.

In some embodiments, the pallet system 20 includes one or more spacers 262 inserted through the plurality of railing segments 32. The spacers 262 may be inserted proximate the pluralities of vertical posts 246*a*, 246*b*. Each spacer 262 includes a first registration surface 261 and an opposed second registration surface 263 separated by a spacer thickness 265 (FIG. 15). In the depicted embodiment, the first plurality of railing segments 32*a* includes a first plurality of mid-railings 264*a*, each mid-railing 236 of the first plurality of mid-railings 264*a* being associated with a respective railing segment 232 of the first plurality of railing segments 32*a*. Each mid-railing 236 of the first plurality of mid-railings 264*a* extends from a respective vertical post 234 of the first plurality of vertical posts 246*a* and is coplanar with a respective registration plane 70 of the first plurality of registration planes 72. The second plurality of railing segments 32*b* includes a second plurality of mid-railings 264*b*, each mid-railing 236 of the second plurality of mid-railings 264*b* being associated with a respective railing segment 232 of the second plurality of railing segments 32*b*. Each mid-railing 236 of the second plurality of mid-railings 264*b* extends from a respective vertical post 234 of the second plurality of vertical posts 246*b* and is coplanar with a respective registration plane 170 of the second plurality of registration planes 172.

In some embodiments, the bottom edge bracket 52 is configured to support the first plurality railing segments 32*a* and the second plurality of railing segments 32*b* so that a vertical clearance 266 is defined between the first plurality of mid-railings 264*a* and the second plurality of mid-railings 264*b*. The spacer 262 is inserted within the vertical clearance 266 to extend laterally through the first plurality of railing segments 32*a* and the second plurality of railing segments 32*b*.

In some embodiments, the pallet system 20 is bound together with bindings 268, for example a strap or metal band 272 that wraps around each end of the pallet system 20. Where straps 272 are implemented, the strap 272 may be routed through the grooves or notches 97, 197 of the edge brackets 52, 152. Bindings other than straps 272 are also contemplated, for example adjustable struts, rods, or threaded rods (none depicted) that extend between and/or through the bottom and top edge brackets 52, 152, not only for applying a primary compression force F1 between the edge brackets 52, 152, but also function to separate the edge brackets 52, 152. In some embodiments, a second spacer 274 is strapped to the hand railings 238 of the second plurality of railing segments 32*b*, for example with a metal band 276.

Functionally, by capturing only the corners of the plurality of railings segments 32, the weight and footprint of an "empty" pallet system 20 is substantially diminished relative to conventional pallets systems. Each edge bracket 52, 152 may be about four feet long (1.2 meters) and less than a foot wide (less than 30 centimeters) and weighs about 20 pounds (9 kilograms). The reduction in weight and footprint enable the edge bracket 52, 152 to be handled by one person when empty, and also makes returning the pallet system to the shipper in a refund exchange arrangement a viable concept. The reduced weight and footprint also reduces material requirements of the pallet system 20 relative to conventional pallets, which can reduce fabrication costs. Furthermore, the reduced weight also reduces the shipping weight of the assembled pallet system 20 relative to conventional pallet systems, saving on shipping costs.

The registration channels 69, 169 of the edge brackets 52, 152 may be configured to mate with the corner portions 242 of the railing segments 232. For example, for railing segments 232 that define the arcuate profile 244 of FIG. 13, the registration channels 69, 169 may also be arcuate, substantially conforming to the outer surface of the arcuate profile 244. It is noted that the arcuate shapes of the corner portions 242 and registration channels 69, 169 are non-limiting. That is, based on the present disclosure, the skilled artisan could design the pallet system 20 mutatis mutandis to accommodate non-arcuate corner portions, such as a substantially square corner profile or an angled corner profile.

The blind apertures 98 cooperate with the first plurality of through-apertures 62 to at least temporarily maintain the first plurality of railing segments 32*a* in an upright configuration. That is, when the vertical post 234 of a given railing segment 232 of the first plurality of railing segments 32*a* is inserted through a given through aperture 60 of the first plurality of through-apertures 62 and into the respective one of the blind apertures 98, the vertical post 234 is maintained substantially upright within the blind aperture 98 by the limited motion imposed on the vertical post 234 imposed by the through aperture 60.

Figure 14:
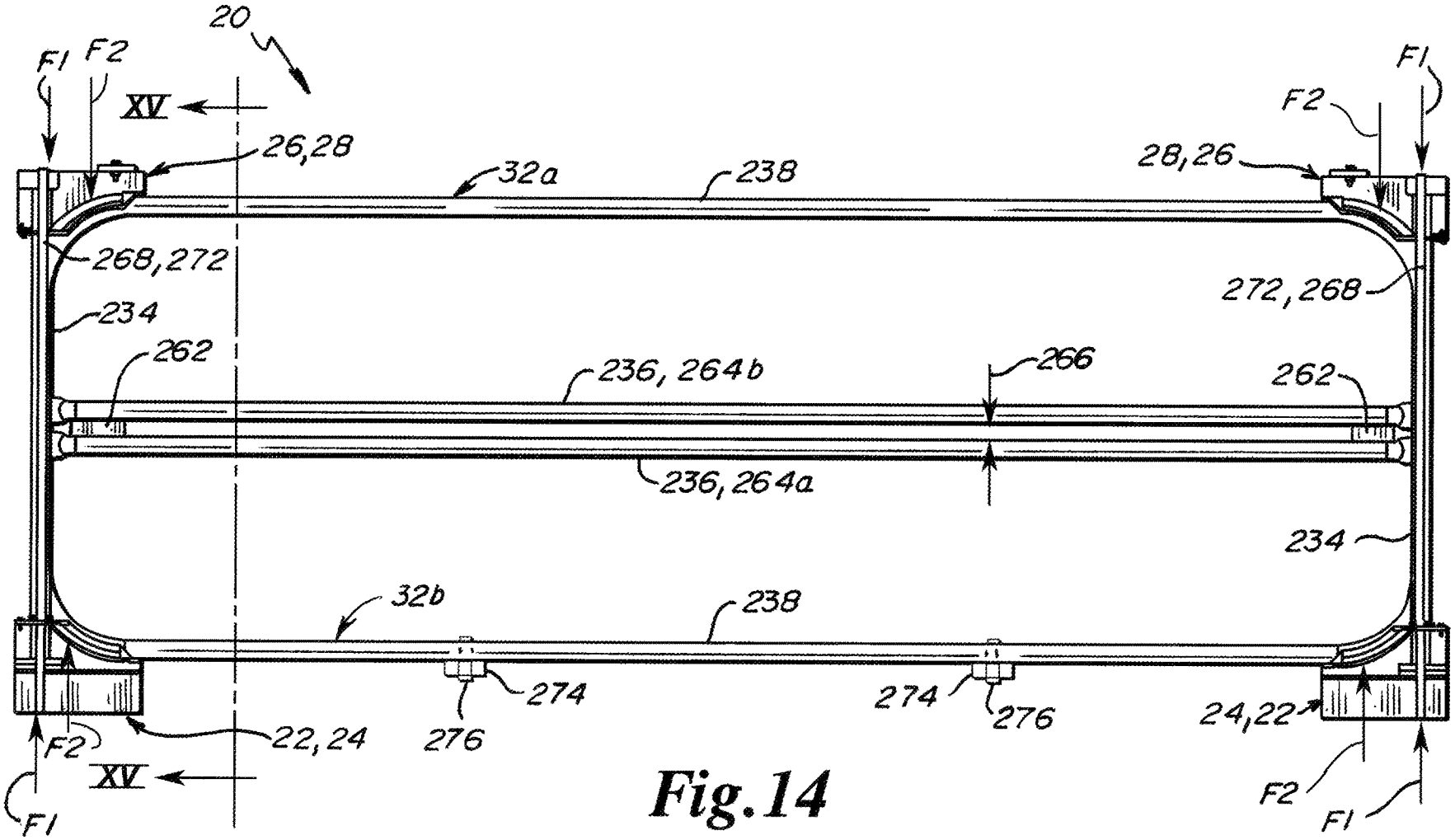
FIG. 14 is an elevational view of the pallet system of FIG. 1 according to an embodiment of the disclosure.
Figure 16:
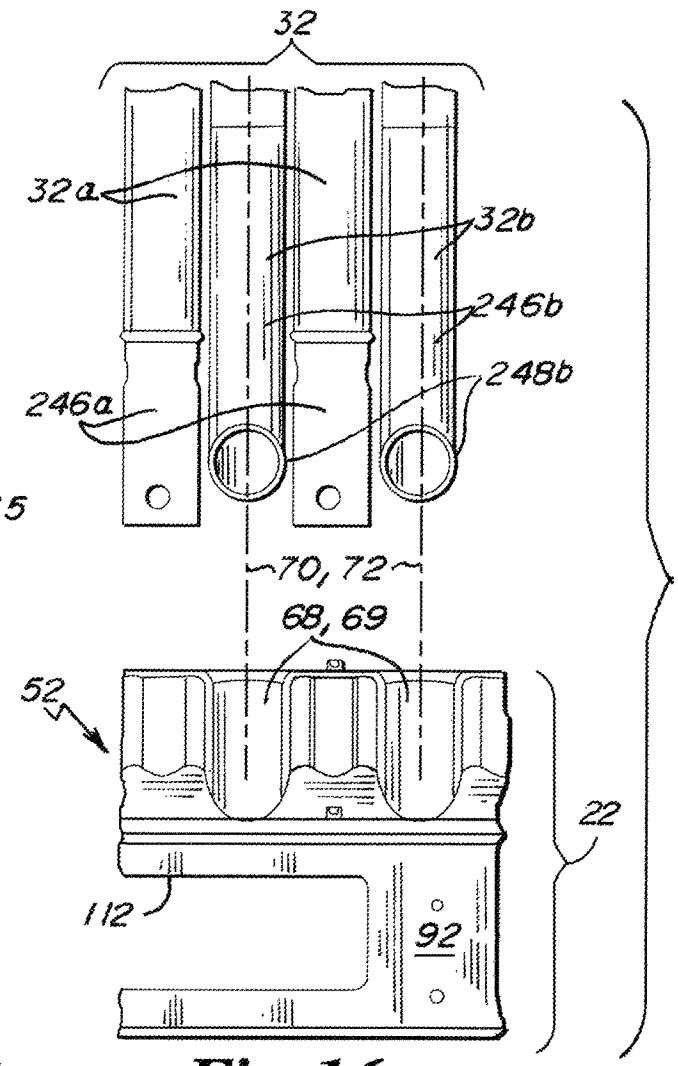
FIG. 16 is an enlarged, partial view of the exploded sectional view of FIG. 15 according to an embodiment of the disclosure.

Accordingly, the first plurality of railing segments 32*a* may be placed free standing within the bottom edge brackets 52 located at the opposed lower corners 24 of the pallet system 20 (FIGS. 1 and 14). During or after placement of the first plurality of railing segments 32*a* within the bottom edge bracket 52, the second plurality of railing segments 32*b* may be seated within the first plurality of registration channels 68 of the opposed bottom edge brackets 52. The plurality of railing segments 32 may be left free standing, with the first plurality of railing segments 32*a* maintained upright by the cooperation of the blind apertures 98 with the first plurality of through-apertures 62, and the second plurality of railing segments 32*b* being maintained upright by the first plurality of railing segments 32*a*.

With the plurality of railing segments 32 free standing within the opposed bottom edge brackets 52, the top edge brackets 152 may be coupled to the assembly. In one embodiment, the top edge bracket 152 is slid downward over the upward-projecting second plurality of vertical posts 246*b* and the second plurality of registration channels 168 brought into contact with the first plurality of corner portions 248*a* of the first plurality of railing segments 32*a*. The procedure is repeated for the top edge bracket 152 located at the opposed upper corner 28 of the pallet assembly 20.

When implemented, the oblong shape of the through-apertures 60, 160 can provide easier initial alignment with the vertical posts 234 of the plurality of railing segments 32. The oblong shape also provides a degree of compliance or "play" during handling of the pallet system 20.

In some embodiments, the bindings 268 are applied to the pallet system 20 with the plurality of railing segments 32 free standing within the opposed bottom edge brackets 52 the opposed top edge brackets 152 at the upper corners 28. For bindings 268 that utilize straps 272, the straps 272 are captured within the grooves or notches 97, 197, preventing the straps 272 from sliding off the ends of the edge brackets 52, 152 during the rigors of shipping and handling. For embodiments where the grooves or notches 97, 197 are centered about the lateral axes 64, 164, placing the straps 272 in tension centers the resulting primary compressive forces F1 along the vertical posts 234 of the first and second pluralities of vertical posts 246*a*, 246*b*. Centering the primary compressive forces F1 acts to seat the edge brackets 52, 152 squarely on the first and second pluralities of vertical posts 246*a*, 246*b*. Specifically, for the depicted embodiment, the primary compressive forces F1 applied by the bindings 268 are exerted on the vertical posts 234 of the first plurality of vertical posts 246*a* at the blind apertures 98 of the bottom edge bracket 52, and on the vertical posts 234 of the second plurality of vertical posts 246*b* at the beam 194 of the addendum 154.

Accordingly, the edge brackets 52, 152 cooperate to capture an end of the plurality of railing segments 32 and hold them together. The primary compressive forces F1 act to retain the first plurality of vertical posts 246*a* within the blind apertures 98. The edge brackets 52, 152 may be configured so that, when the primary compressive force F1 is applied by the bindings 268, there is also a secondary contact force F2 between the respective plurality of registration channels 68, 168 and the plurality of corner portions 248*a*, 248*b* of the plurality of railing segments 32 (FIG. 14). In some embodiments, the secondary contact forces F2 are sufficient to seat the corner portions 248*a*, 248*b* firmly within the plurality of registration channels 68, 168, but substantially less than the primary compression forces F1 applied to the pluralities of the vertical posts 246*a*, 246*b*. In this way, the secondary compression forces F2 do not impart significant torsion or twisting on the edge brackets 52, 152 about the lateral axes 64, 164 relative to the primary compression forces F1.

The spacers 274 provide for registration of forklift tines during handling of an assembled pallet system 20. That is, the spacers 274 are located on the pallet system 20 so that forklift tines (not depicted) that pass through the openings 112 will register against a bottom face of the spacer 274, enabling the pallet assembly 20 to be lifted by the forklift tines without damage to the hand railings 238 of the second plurality of railing segments 32*b*.

The spacer(s) 262 acts to relieve the bindings 268 of excessive tension forces during handling. That is, during shipping, handling and storage, lifting the pallet assembly 20 from one end may cause the first and second plurality of railing segments 32*a* and 32*b* to rotate with respect to each other in a way that exerts additional tension load on the bindings 268. With the spacer(s) 262 in place, such rotation or would-be rotation between the first and second plurality of railing segments 32*a* and 32*b* in the x-z plane causes the mid-railings 264*a* of the first plurality of railing segments 32*a* to seat against the first registration surface 261 of the spacer(s) 266 and the mid-railings 264*b* of the second plurality of railing segments 32*b* to seat against the second registration surface 263 of the spacer(s) 266. Accordingly, the spacers 262 effectively bridge the first and second pluralities of railing segments 32*a* and 32*b* together in a fixed relationship when the pallet system 20 is lifted from one end, thereby preventing relative rotation between the pluralities of railing segments 32*a* and 32*b* in a direction that would exert additional tensions on the bindings 268.

In the depicted embodiment, the interlocking features 222 act to restrict lateral and fore/aft movement of the bottom edge bracket 22 with respect to an adjacent top edge bracket 26 when a plurality of pallet systems 20 are vertically stacked. If restriction of movement along the z-axis between stacked or otherwise adjacent pallet systems 20 is desired, an additional binding (e.g., an additional strap) may be routed continuously through the grooves or notches 97, 197 of all of the plurality of pallet systems 20 (not depicted) to exert a compressive force between the plurality of pallet systems 20.

Each of the additional figures and methods disclosed herein can be used separately, or in conjunction with other features and methods, to provide improved devices and methods for making and using the same. Therefore, combinations of features and methods disclosed herein may not be necessary to practice the disclosure in its broadest sense and are instead disclosed merely to particularly describe representative and preferred embodiments.

Various modifications to the embodiments may be apparent to one of skill in the art upon reading this disclosure. For example, persons of ordinary skill in the relevant arts will recognize that the various features described for the different embodiments can be suitably combined, un-combined, and re-combined with other features, alone, or in different combinations. Likewise, the various features described above should all be regarded as example embodiments, rather than limitations to the scope or spirit of the disclosure.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

Unless indicated otherwise, references to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A pallet system for shipping railing segments, comprising:

a bottom edge bracket including a bottom rack portion, said bottom rack portion defining a first plurality of through-apertures that are spaced along a first axis, an upper face of said bottom rack portion defining a first plurality of registration channels, each of said first plurality of registration channels defining and being centered about a respective registration plane to define a first plurality of registration planes of said bottom rack portion, said first plurality of registration planes being orthogonal to said first axis; and a top edge bracket including a top rack portion, said top rack portion defining a second plurality of through-apertures that are spaced along a second axis, a lower face of said top rack portion defining a second plurality of registration channels, each of said second plurality of registration channels defining and being centered about a respective registration plane to define a second plurality of registration planes of said top rack portion, said second plurality of registration planes being orthogonal to said second axis, wherein said top edge bracket is configured such that, when suspended above said bottom edge bracket so that said lower face of said top rack portion faces said upper face of said bottom rack portion and said first axis of said bottom edge bracket is coplanar with said second axis of said top edge bracket, each through-aperture of said first plurality of through-apertures of said bottom rack portion is centered about a respective registration plane of said second plurality of registration planes of said top edge bracket, and each through-aperture of said second plurality of through-apertures of said top rack portion is centered about a respective registration plane of said first plurality of registration planes of said bottom edge bracket.

2. The pallet system of claim 1, wherein said first axis and said second axis are linear.

3. The pallet system of claim 1, wherein said first plurality of through-apertures and said second plurality of through-apertures are uniformly shaped.

4. The pallet system of claim 1, wherein said first plurality of through apertures are uniformly spaced along said first axis, and said second plurality of through apertures are uniformly spaced along said second axis.

5. The pallet system of claim 1, wherein:

said first plurality of registration channels of said bottom rack portion defines a first plurality of arcuate axes, each arcuate axis of said first plurality of arcuate axes extending orthogonal to said first axis and being coplanar with a respective registration plane of said first plurality of registration planes; and said second plurality of registration channels of said top rack portion defining a second plurality of arcuate axes, each arcuate axis of said second plurality of arcuate axes extending orthogonal to said second axis and being coplanar with a respective registration plane of said second plurality of registration planes.

6. The pallet system of claim 5, wherein:

each registration channel of said first plurality of registration channels includes a concave surface that is concave relative to said upper face of said bottom rack portion, said concave surface of said registration channel of said upper face of said bottom rack portion defining a radius that is normal to a corresponding arcuate axis of said first plurality of arcuate axes; and each registration channel of said second plurality of registration channels includes a concave surface that is concave relative to said lower face of said top rack portion, said concave surface of said registration channel of said lower face of said top rack defining a radius that is normal to a corresponding arcuate axis of said second plurality of arcuate axes.

7. The pallet system of claim 1, wherein:

said bottom edge bracket includes a base assembly that extends from said bottom rack portion; and said top edge bracket includes an addendum that extends from said top rack portion.

8. The pallet system of claim 7, wherein said bottom edge bracket includes a first plurality of blind apertures defined on said base assembly, each blind aperture of said first plurality of blind apertures being in alignment with a respective through-aperture of said first plurality of through-apertures along a respective axis that is coplanar with a respective registration plane of said first plurality of registration planes and perpendicular to said first axis.

9. The pallet system of claim 7, wherein said base assembly is configured to mount on said addendum.

10. The pallet system of claim 9, wherein said base assembly and said addendum include features configured to interlock for restricting movement of said bottom edge bracket with respect to said top edge bracket.

11. The pallet system of claim 10, wherein said features include a locking aperture defined on one of said base assembly and said addendum and a protrusion on the other of said addendum and said base assembly, said protrusion being configured to mate with said aperture.

12. The pallet system of claim 1, wherein said bottom edge bracket defines a pair openings for accommodation of fork lift tines, each of said pair of openings facing in a direction that is orthogonal to said first axis.

13. The pallet system of claim 12, wherein each of said pair of openings is normal to said direction that is orthogonal to said first axis.

14. The pallet system of claim 1, comprising a first plurality of railing segments that suspends said top edge bracket above said bottom edge bracket, wherein:

said first plurality of railing segments includes a first plurality of vertical posts, each vertical post of said first plurality of vertical posts being associated with a respective railing segment of said first plurality of railing segments, each vertical post of said first plurality of vertical posts being disposed in a respective through-aperture of said first plurality of through-apertures of said bottom rack portion; and said first plurality of railing segments includes a first plurality of corner portions, each corner portion of said first plurality of corner portions being associated with said respective railing segment of said first plurality of railing segments, each corner portion of said first plurality of corner portions being disposed in a respective registration channel of said second plurality of registration channels of said top rack portion.

15. The pallet system of claim 14, comprising a second plurality of railing segments, wherein:

said second plurality of railing segments includes a second plurality of vertical posts, each vertical post of said second plurality of vertical posts being associated with a respective railing segment of said second plurality of railing segments, each vertical post of said second plurality of vertical posts being disposed in a respective through-aperture of said second plurality of through-apertures of said top rack portion; and said second plurality of railing segments includes a second plurality of corner portions, each corner portion of said second plurality of corner portions being associated with said respective railing segment of said second plurality of railing segments, each corner portion of said second plurality of corner portions being disposed in a respective registration channel of said first plurality of registration channels of said bottom rack portion.

16. The pallet system of claim 15, comprising a spacer, wherein:

said first plurality of railing segments includes a first plurality of mid-railings, each mid-railing of said first plurality of mid-railings being associated with a respective railing segment of said first plurality of railing segments, each mid-railing of said first plurality of mid-railings extending from a respective vertical post of said first plurality of vertical post and being coplanar with a respective registration plane of said first plurality of registration planes;

said second plurality of railing segments includes a second plurality of mid-railings, each mid-railing of said second plurality of mid-railings being associated with a respective railing segment of said second plurality of railing segments, each mid-railing of said second plurality of mid-railings extending from a respective vertical post of said second plurality of vertical posts and being coplanar with a respective registration plane of said second plurality of registration planes;

said bottom edge bracket being configured to support said first plurality railing segments and said second plurality of railing segments so that a vertical clearance is defined between said first plurality of mid-railings and said second plurality of mid-railings; and said spacer is inserted within said vertical clearance to extend through said first plurality of railing segments and said second plurality of railing segments.

17. A method for shipping a plurality of railing segments, comprising:

arranging a first plurality of railing segments laterally with respect to each other, each of said first plurality of railing segments being in a first orientation, each of said first plurality of railing segments including a cross member to define a first plurality of cross-members;

arranging a second plurality of railing segments laterally with respect to each other, each of said second plurality of railing segments being in a second orientation, each of said second plurality of railing segments including a cross member to define a second plurality of cross-members, said second orientation being inverted from said first orientation of said first plurality of railing segments, said second plurality of railing segments being laterally interspersed with said first plurality of railing segments; and inserting a spacer between said first plurality of cross members and said second plurality of cross members, said first plurality of cross members being adjacent a first registration surface of said spacer for seating of said first plurality of cross members, said second plurality of cross members being adjacent a second registration surface of said spacer for seating of said second plurality of cross members, said second registration surface of said spacer and said first registration surface of said spacer facing in opposite directions.

18. The method of claim 17, wherein said cross member is a mid-railing.

19. The method of claim 17, comprising coupling said first plurality of railing segments to said second plurality of railing segments.

20. The method of claim 19, wherein the step of coupling is performed by wrapping a band around said first plurality of railing segments and said second plurality of railing segments.

* * * * *